US008641110B1

(12) United States Patent
Perry

(10) Patent No.: US 8,641,110 B1
(45) Date of Patent: Feb. 4, 2014

(54) MULTI-PURPOSE REACHER-GRABBER TOOL

(76) Inventor: Douglas D. Perry, Montverde, FL (US)

( * ) Notice: Subject to any disclaimer, the term of this patent is extended or adjusted under 35 U.S.C. 154(b) by 0 days.

(21) Appl. No.: 13/568,392

(22) Filed: Aug. 7, 2012

Related U.S. Application Data

(60) Provisional application No. 61/527,665, filed on Aug. 26, 2011.

(51) Int. Cl.
*A47F 13/06* (2006.01)

(52) U.S. Cl.
USPC ..... 294/24; 294/209; 294/211

(58) Field of Classification Search
USPC ..... 294/24, 209, 210, 211, 2, 22, 23, 26
See application file for complete search history.

(56) References Cited

U.S. PATENT DOCUMENTS

| | | | | | |
|---|---|---|---|---|---|
| 366,369 | A | * | 7/1887 | Bierman | 294/23 |
| 551,433 | A | * | 12/1895 | Cozens | 294/211 |
| 1,197,139 | A | * | 9/1916 | Mastin | 294/24 |
| 4,441,746 | A | | 4/1984 | Corboy, Jr. | |
| 4,613,179 | A | | 9/1986 | van Zelm | |
| 4,622,868 | A | * | 11/1986 | Flannigan | 81/15.9 |
| 5,823,590 | A | | 10/1998 | Forrest et al. | |
| 5,964,489 | A | * | 10/1999 | Mahoney | 294/24 |
| 6,352,291 | B1 | * | 3/2002 | Tortajada | 294/24 |
| 6,467,823 | B1 | * | 10/2002 | Brekken | 294/211 |
| 6,572,062 | B1 | * | 6/2003 | Limber et al. | 248/227.1 |
| 7,429,067 | B1 | * | 9/2008 | Rosa | 294/175 |
| 8,091,936 | B1 | | 1/2012 | Graziano | |
| 8,376,430 | B1 | * | 2/2013 | Lee | 294/24 |
| 2001/0048229 | A1 | * | 12/2001 | Prass | 294/24 |
| 2008/0061571 | A1 | * | 3/2008 | Schopp | 294/24 |
| 2010/0320784 | A1 | * | 12/2010 | Rosenbaum | 294/26 |

* cited by examiner

*Primary Examiner* — Saul Rodriguez
*Assistant Examiner* — Gabriela Puig
(74) *Attorney, Agent, or Firm* — John V. Stewart

(57) ABSTRACT

A tool with two interconnected appendages extending in two different directions from an end of an interchangeable extension pole. The first appendage may be oriented along a plane substantially parallel to the pole axis. The second appendage may be oriented along a plane substantially normal to the axis. An open-ended slot may be provided in each appendage for grabbing cords and other items. At least one of the open-ended slots may graduate from a larger width at an open end of the slot to a reduced width toward a closed end of the slot. Pull-chains to be operated can be inserted and locked into the smaller portion of the slot. Stop surfaces may be provided that limit insertion of an appendage to a specific distance, for example to operate a louver of a window shutter. Internal Acme threads may be provided in the tool to attach it to existing poles.

9 Claims, 3 Drawing Sheets

MULTI-PURPOSE REACHER-GRABBER TOOL

CROSS-REFERENCES TO RELATED APPLICATIONS

This application claims the priority benefit of pending provisional patent application 61/527,665, filed on Aug. 26, 2011.

FIELD OF THE INVENTION

The invention relates to multi-purpose reacher-grabber tools offering functionality to reach and manipulate hard-to-reach objects.

BACKGROUND

Various types of reacher-grabber tools are known in the prior art. Examples are found in U.S. Pat. No. 8,091,936 issued to Graziano on January 2011; U.S. Pat. No. 4,613,179 issued to van Zelm on September 1986; U.S. Pat. No. 4,441,746 issued to Corboy, Jr. on April 1984; U.S. Pat. No. 5,823,590 issued to Forrest on October 1998, and U.S. Pat. No. 6,467,823 issued to Brekken on October 2002.

Prior reacher-grabber tools provide clamping appendages with gripping ends that extend from an end of a pole. The appendages open and close by squeezing a spring handle style trigger or pulling a rope at the opposite end of the pole. This conventional form of reacher-grabber tool has limitations for the user with weak finger muscles or no gripping capability. It has a fixed reach length due to the operating mechanism. A limited number of tasks can be performed by the apparatus. Such prior tools have some or all of the following disadvantages:

- The reach of the tool is fixed by the length of the operator linkage to the grasping apparatus, making interchangeable or extendable poles impractical. This lack of extendability means a ladder is needed by the operator for very high and very low distances.
- The clamping appendages must be manipulated into an open position before being able to grasp or hook the work object, thus requiring additional space to perform the action.
- Lacks capability to adjust plantation style window shutter louvers.
- Lacks capability to lock some types of objects into the tool including pull-chains positioned at any angle as well as wire and cord with or without a pull-button for manipulation.
- Clamping fingers require an opposed moving finger to grasp a work object. A single finger cannot clamp or grasp the work object independently.
- The contact mechanism provides only one suitable engagement angle, so only one approach angle is available.
- Operating two movable handle pieces or devices makes it difficult to rotate the tool 360 degrees in either direction with one hand.
- Multi-purpose functionality for additional tasks such as scraping is not facilitated.
- The force used to retrieve or manipulate an object once contact is made is left to the operator's hand squeezing strength on the trigger or handles to provide the necessary force to retain the object within the clamping appendages.

- No part stops insertion of an appendage at a specific distance relative to a work object such as a louver for opening and closing the louver on one side of its pivot axis.

SUMMARY OF THE INVENTION

An object of the present invention is to provide a reacher-grabber tool with changeable reach lengths. Another object is such tool without moving parts, thus making it useable in a close tolerance environment. Another object is to provide such tool that can operate at more than one angle. Another object is to provide such tool that can grip pull-cords, pull-chains, and the like, with or without a stop button on the pull-cord. Another object is to provide such tool that can be operated without a manual squeezing or rope-pulling action, and can be operated with one hand. Further objects, operations, and benefits are described later herein.

These objects and others are achieved with a multi-purpose reacher-grabber tool having two interconnected appendages extending in two different directions from an end of an interchangeable extension pole. The first appendage may be oriented along a plane substantially parallel to the pole axis, while the second appendage may be oriented along a plane substantially normal to the axis, thus providing a range of object manipulation angles. An open-ended slot may be provided in one or each appendage for grabbing cords and other items. At least one of the open-ended slots may graduate from a larger width at its open end to a reduced width nearer its closed end. Pull-chains to be operated can be inserted into the smaller portion of the slot, and locked therein. Surfaces may be provided on the tool that stop insertion of an appendage at a specific distance, for example to operate a louver of a window shutter on one side of a pivot axis thereof. Internal Acme threads may be provided in the tool to attach it to existing poles.

BRIEF DESCRIPTION OF THE DRAWINGS

The invention is explained in the following description in view of the drawings that show.

DETAILED DESCRIPTION

Figure 1:
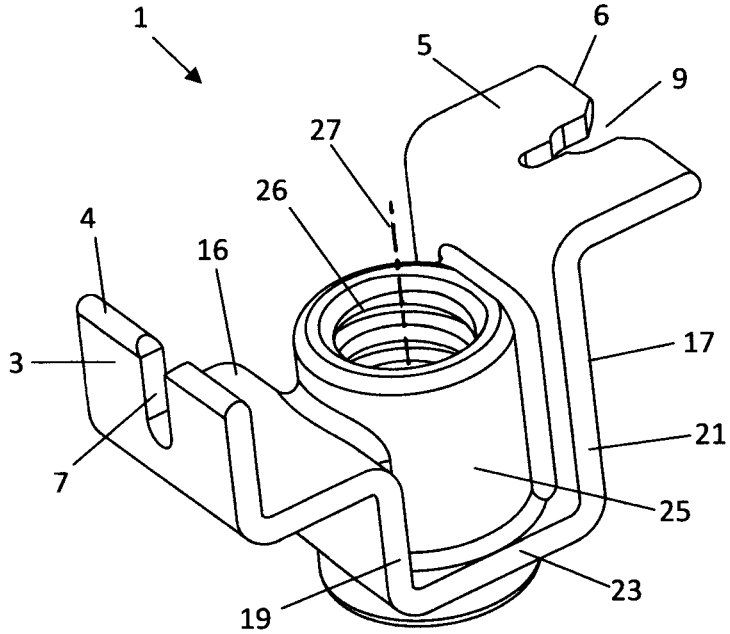
FIG. 1 is front/left perspective view of a multi-purpose reacher-grabber tool according to an embodiment of the invention.
Figure 2:
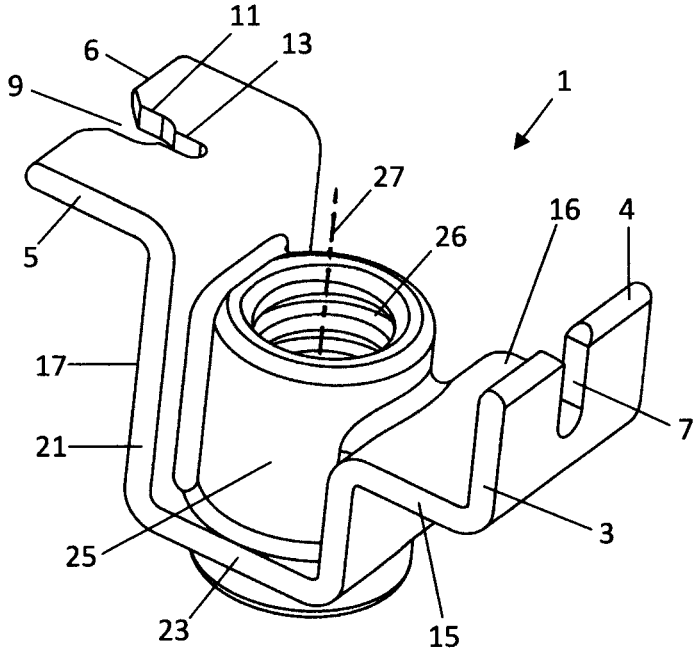
FIG. 2 is a back/left perspective view of the embodiment of FIG. 1.

FIGS. 1 and 2 show a multi-purpose reacher-grabber tool 1 useful for adjusting, hooking, pulling, pushing, lifting, scraping, and retrieving hard-to-reach objects, and for other such manipulations. The tool attaches to an extension pole by a pole-connection mechanism 25 which may have internal threads 26 for threaded engagement with threads on a pole end. The tool 1 may be made from materials such as a strong plastic like Acrylonitrile Butadiene Styrene (ABS), or other plastics, aluminum, steel, or other metals. The tool provides first and second interconnected appendages 3 and 5, each appendage having a respective open-ended slot 7 and 9. The first appendage 3 may be oriented along a plane that is substantially parallel or within 10° of parallel to an axis 27 of the pole-connection mechanism 25. The second appendage 5 may be oriented along a plane that is substantially normal or within 10° of normal to the axis 27 of the pole-connection mechanism 25. At least one of the open-ended slots 9 may be graduated by having an open-ended distal portion 11 with a first width, and a proximal portion 13 with a second narrower width. The second width may be generally or substantially uniform along a length of said proximal portion as shown.

The first appendage 3 may extend at a substantially right angle from a first stop plate 15. A stop surface 16 limits the insertion depth of the first appendage 3, for example when adjusting window shutters by pushing or pulling against an edge of a louver or slat thereof such that the distal edge 4 of the first appendage does not penetrate past the rotation axis of the louver. The second appendage 5 may extend at a substantially right angle from a second stop plate 21. A second stop surface 17 may be provided to limit insertion depth of a distal edge 6 the second appendage 5.

The two interconnected appendages 3 and 5 may be formed from a flat bar that includes the 1 portions labeled 3, 5, 15, 19, 21, and 23 with a central portion 19, 21, 23 bent into a generally "U" shape having two sides 19, 21, and a bottom 23. The pole-connection mechanism 25 may be bracketed by this U-shaped portion. The pole-connection mechanism may be integral with the U-shaped portion or attached thereto by any means, such as molding, bonding, welding, or brazing. Alternately, the pole connection mechanism may be a flat-sided nut on which the U-shaped portion serves as a wrench as later shown.

The open-ended slots 7 and 9 accept insertion of any object or part thereof that will fit into either slot width for manipulation. The work object may have a bottom portion larger in size than any part of open-ended slot. This enables tasks such as removing a wasp nest or pulling blind cords, fan chains, and vegetation branches. If the work object does not have a bottom portion larger in size than any part of the open-ended slot, then the tool 1 may be angled or twisted by angling or twisting the pole on which the tool is mounted to lock an object such as a smooth cord in the slot.

Figure 3:
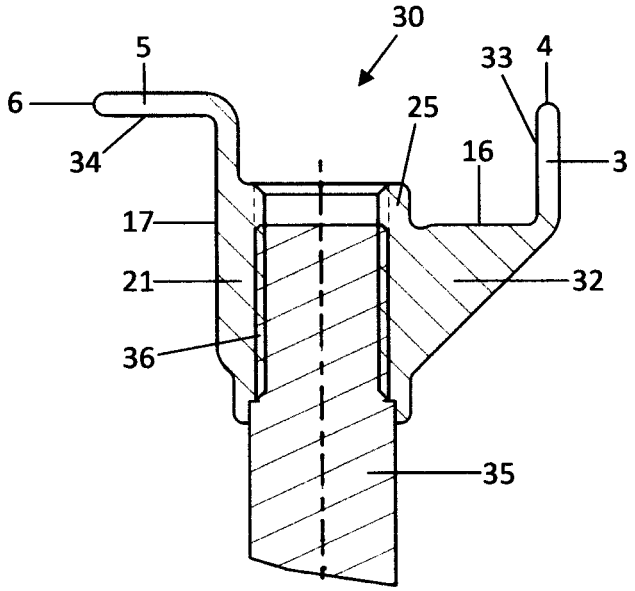
FIG. 3 is a front sectional view of a second embodiment of the invention attached to an extension pole.

FIG. 3 is a sectional view of an embodiment 30 the invention having a diagonal brace 32. A hooking surface 33 on the first appendage 3 may be used for manipulations such as hooking and lifting. A hooking surface 34 on the second appendage 5 may be used for manipulations such as hooking, pulling, and lifting. Open-ended slots, not shown in this figure, may be provided as previously shown. The tool may be connected to a pole 35 by a threaded connection 36. Standard Acme internal threads may be provided in the pole-connection mechanism 25, so that common extension poles may be used interchangeably, such as a mop handle, a paint roller extension pole, and the like, depending on the reach distance needed.

Figure 4:
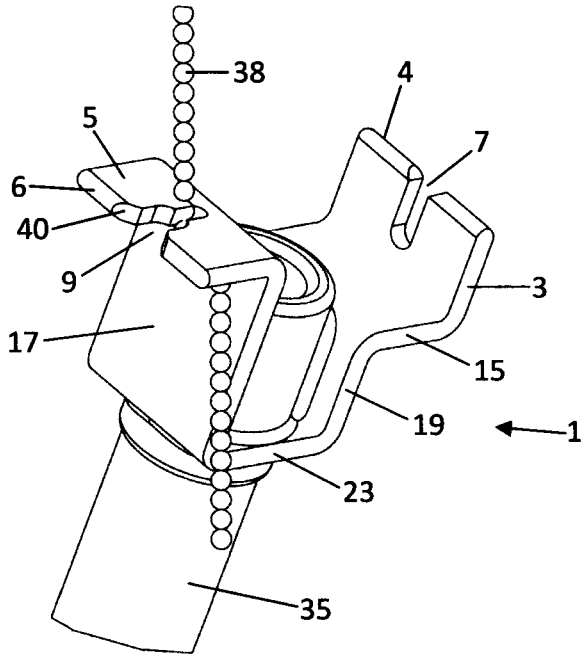
FIG. 4 is a right/rear perspective view of the embodiment of FIG. 1 attached to an extension pole showing a pull-chain locked into a graduated open-ended slot.

FIG. 4 illustrates the tool 1 being used to manipulate a flexible beaded chain 38 using the graduated open-ended slot 9, 11, 13 previously described. The chain 38 may be guided into the slot by object feeder chamfers 40 at the distal corners of the open-ended slot 9. It may then be further guided into the narrow portion 13 of the slot if it fits. The operator may then change the angle of the tool, after beaded chain 38 is seated, by elevating the extension pole 35 upward by approximately 15 degrees or more or by twisting the pole. Such movement increases the friction or interference on the beaded chain 38 from the open-ended slot wall edges. The stop surface 17 may assist with stabilizing objects in the open-ended slot 9.

The other open-ended slot 7 is capable of performing similar friction operations, but is especially suitable for locking objects that are positioned in a flat horizontal position, or approximate degree thereof, because of its vertical angle when reaching upward or downward. Open-ended slot 7 can lock horizontal objects that fit into its width by twisting the extension pole 35, thus creating friction between the object and edges of the open-ended slot.

The open-ended slots 7 and 9 may also be used to manipulate an inserted object of fitting size without frictional locking of the object for lifting, lowering, rotating, and other manipulations at the operator's discretion. Open-ended slot 7, because of its linear alignment with extension pole 35, offers an advantage during limited angular access to the work object, such as operating in a limited work space where minimal movement is possible except for rotation of extension pole 35. This may be useful in an access hole of small diameter.

Figure 5:
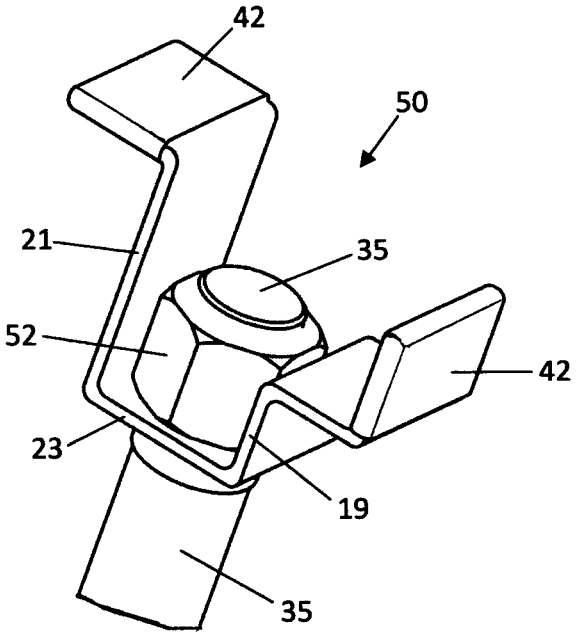
FIG. 5 is a back/left perspective view of a third embodiment of the invention showing soft sleeve covers on the appendages and a hexagonal nut bracketed by a U-shaped central portion of a flat bar which serves as a wrench on the nut.

FIG. 5 illustrates and embodiment 50 two removable soft sleeve covers 42 on the appendages 3 and 5. These covers 42 may be made of a softer material than the appendages, such as vinyl. They may be used on any embodiment shown herein. They protect the work object from scratches when the open-ended slots are not needed, such as for pushing or pulling an edge of a window louver to open or close it. FIG. 5 also shows the tool formed from a flat bar with a central U-shaped portion 19, 21, 23 serving as a wrench on a flat-sided nut 52.

Operation

Soft sleeve covers 42 may be placed on one or both appendages as needed for protection of the work object finish and for improved surface friction on the work object. The covers 42 can be removed for functions that use the appendage edges or surfaces and/or the open-ended slots 7 and 9. Sliding glass door tracks can be cleaned by sliding a cloth in the tracks with the tool. The first or second appendage may be used to push the cloth to the bottom of the track. The tool can adjust plantation style window shutter louvers at extreme distances or other hard-to-reach areas, such as over/around obstructions. Either appendage 3, 5 can be used for opening, closing, or fine adjustment of the louver. The soft sleeve covers 42 on the appendages provide frictional grip and protection of the louver and other object surface finishes. This tool eliminates the need for a ladder or other device such as a remote electrical actuator. By simple hand-arm manipulation of the attached extension pole affecting the angle of the tool, the louvers can be adjusted as needed for light, air, and thermal control. The tool may include stop surfaces 16, 17 that limit appendage insertion depths for preventing hinge damage to shutter louvers and other objects and for ease of object retrieval. As a result of the stop surfaces, the tips 4, 6 of the appendages 3, 5 may be limited so as not to pass the axis of the hinge pin of the louver while being manipulated from an edge of the louver. The tool can grasp and lock cords, rope, chain, and beaded chain for electrical switching, opening of attic doors, and other such purposes. The tool can hold objects for installation, such as placing an adhesive-backed hanger hook onto a hard to reach contact surface by pressing such hook into an interference fit in an open-ended slot 7 or 9. Each appendage 3, 5 may have functional surfaces on at least two sides of the appendage that provide pushing surfaces in four directions relative to a given access angle. The tool can provide scraping capability in any of four directions with the soft sleeve covers 42 removed. The tool does not require grip strength and/or two hands to operate a clamping mechanism as in prior devices. This makes the tool especially useful for physical handicapped persons. The tool can easily be rotated 360 degrees with one hand for a secure locking and gripping action within minimal operating space.

The tool may provide for interchangeable attachment of extension poles of various lengths with standard Acme threads. The two appendages 3, 5 may be thin, offering ease of insertion between close-tolerance objects. This tool function is more cost effective than motorized manipulation, especially where electricity or simplicity of wiring installation is not presently available. The appendages are capable of hooking objects for lifting and retrieving by inserting the appropriate appendage into a cavity or hole that is part of the object, or by hooking part of the object. Other object examples are bucket handles, flower pot chains, clock open wire frame. The present invention provides a multi-purpose reacher-grabber tool providing plural contact options, which performs manipulation of remote work objects, and which utilizes appendages with open-ended slots implementing friction contact principles.

Having thus described in detail preferred embodiments of the invention, it is to be understood and will be apparent to those skilled in the art that many changes not exemplified in the detailed description of the invention could be made without altering the inventive concepts and principles embodied therein. It is also to be appreciated that numerous embodiments incorporating only part of the preferred embodiment are possible which do not alter, with respect to those parts, the inventive concepts and principles embodied therein. The presented embodiments are therefore to be considered in all respects exemplary and/or illustrative and not restrictive, the scope of the invention being indicated by the appended claims, and all alternate embodiments and changes to the embodiments shown herein which come within the meaning and range of equivalency of the appended claims are therefore to be embraced therein.

I claim:

1. A reacher-grabber tool, comprising:

first and second interconnected substantially planar appendages extending in respective first and second directions from a pole-connection mechanism;

a first open-ended slot in a distal edge of the first appendage; and a second open-ended slot in a distal edge of the second appendage;

wherein the first and second appendages are disposed on substantially opposite sides of the pole-connection mechanism;

wherein the first appendage extends at a substantially right angle from a first stop plate of the reacher-grabber tool, and the second appendage extends at a substantially right angle from a second stop plate of the reacher-grabber tool; and wherein the pole-connection mechanism comprises a threaded nut that engages a threaded end of a pole; the first appendage is oriented along a plane that is substantially parallel to an axis of the pole-connection mechanism; and the second appendage is oriented along a plane that is substantially normal to the axis of the pole-connection mechanism.

2. The reacher-grabber tool of claim 1, wherein the interconnected appendages are formed from a flat bar with a central portion bent into a generally "U" shape, and the nut is bracketed by the "U" shaped portion of the flat bar.

3. The reacher-grabber tool of claim 2, wherein the U-shaped portion comprises a wrench on the nut.

4. The reacher-grabber tool of claim 1, wherein said at least one of the open-ended slots comprise an open-ended distal portion with a first width, and a proximal portion with a second narrower width that is substantially uniform along a length of the proximal portion.

5. The reacher-grabber tool of claim 1, further comprising a removable sleeve cover on at least one of the appendages, wherein the sleeve cover is relatively softer than said at least one appendage.

6. A reacher-grabber tool, comprising:

first and second interconnected substantially planar appendages extending in respective first and second directions on substantially opposite sides of an end of a pole;

a first open-ended slot in the first appendage; and a second open-ended slot in the second appendage;

wherein the first appendage is oriented along a plane that is within 10° of parallel to an axis of the pole end, and the second appendage is oriented along a plane that is within 10° of normal to the axis of the pole end;

wherein the first appendage extends at a substantially right angle from a first stop surface on the tool, and the second appendage extends at a substantially right angle from a second stop surface on the tool; and wherein the appendages are attached to the pole by a threaded nut on the tool engaged with the threaded end of the pole.

7. The reacher-grabber tool of claim 6, wherein the interconnected appendages are formed from a flat bar with a central portion bent into a generally "U" shape, and the nut is bracketed by the U-shaped portion of the flat bar.

8. The reacher-grabber tool of claim 7, wherein the second open-ended slot comprises an open-ended distal portion with a first width and a closed-ended proximal portion with a second width that is narrower than the first width and substantially uniform along a length of the proximal portion.

9. The reacher-grabber tool of claim 6, wherein the appendages are made of relatively hard plastic or metal, and further comprising a removable sleeve cover on at least one of the appendages, wherein the sleeve cover is relatively softer than said at least one appendage.

* * * * *